United States Patent [19]

LeBlanc

[11] Patent Number: 4,643,275

[45] Date of Patent: Feb. 17, 1987

[54] SAFETY LADDER DEVICE

[76] Inventor: Gerard J. LeBlanc, 1323 Worcester Rd., Framingham, Mass. 01701

[21] Appl. No.: 819,391

[22] Filed: Jan. 16, 1986

Related U.S. Application Data

[63] Continuation-in-part of Ser. No. 641,874, Aug. 17, 1984, abandoned.

[51] Int. Cl.[4] ..... E06C 1/36; E06C 7/48

[52] U.S. Cl. ..... 182/107; 182/45; 182/93; 182/206

[58] Field of Search ..... 182/45, 206, 93, 229, 182/150, 107; 248/237, 301, 307

[56] References Cited

U.S. PATENT DOCUMENTS

| | | | |
|---|---|---|---|
| 328,999 | 10/1885 | Ballmann | 182/121 |
| 528,169 | 10/1894 | Kenison | 182/45 |
| 1,374,060 | 4/1921 | Chute | 182/107 |
| 1,433,236 | 10/1922 | Schaaf | 182/107 |
| 1,495,485 | 5/1924 | Jersomann | 248/301 |
| 1,994,369 | 3/1935 | Risser | 182/206 |
| 2,327,317 | 8/1943 | Randall | 182/107 |
| 2,446,093 | 7/1948 | Lambert | 182/45 |
| 3,552,522 | 1/1971 | Bobo | 182/150 |
| 4,143,743 | 3/1979 | Larson | 182/206 |
| 4,164,269 | 8/1979 | Jackson | 248/210 |

*Primary Examiner*—Reinaldo P. Machado
*Attorney, Agent, or Firm*—John E. Toupal; Harold G. Jarcho

[57] ABSTRACT

The invention is a climbing device comprising a ladder with a pair of spaced apart upright members for leaning against a structure and a plurality of spaced apart rungs each extending between and supported by the upright members, a stabile support member having a base portion for securement to the structure and a retainer portion engaged with one of the rungs and selectively disengageable therefrom, and fastening means for fixing the base portion to the structure. The securely fastened stabile support prevents slippage of the ladder and together therewith provides a safe apparatus for climbing structures.

15 Claims, 9 Drawing Figures

SAFETY LADDER DEVICE

CROSS-REFERENCE TO RELATED APPLICATION

This application is a continuation-in-part of U.S. patent application Ser. No. 06/641,874, "Ladder Stabilizing Device", filed Aug. 17, 1984 and now abandoned.

BACKGROUND OF THE INVENTION

The present invention relates generally to safety apparatus for use in climbing structures and, more particularly, includes a support device for stabilizing a ladder against the structure.

Ladders are frequently used to scale structures such as buildings. A susceptability to slippage of such ladders subjects users thereof to the risk of injury. The slippage can be occasioned by wind, a sudden unbalancing, a loose structural member, or any of a number of other causes.

Solutions to this problem have been proposed in U.S. Pat. No. 1,374,060 (Chute) which discloses a ladder clamp which clamps over the vertical side beam of a ladder and over the edge of a gutter; U.S. Pat. No. 1,433,236 (J. Schoor and W. Thmaskoff) which discloses an attachment comprising a clamp secured around a vertical side beam of a ladder and further comprising a pointed end which "spikes" a building surface to prevent sideways slippage; U.S. Pat. No. 2,327,317 (F. O. Rondell) which discloses an attachment for a ladder for working around windows or a cornice; U.S. Pat. No. 1,994,369, (R. H. Risser) which discloses a brace for a round structure; U.S. Pat. No. 4,143,743 (Larson) which discloses an apparatus for removably clamping a ladder to the eaves of a building; and U.S. Pat. No. 4,164,269 (Jackson) which discloses a safety bracket for a ladder which has two extending arm members interconnecting in a crossing relation one end of each is secured to a roof and the other end formed out to a hook-shaped portion which may be hooked around an upright member of a ladder. None of these prior devices provides a climbing apparatus which is both completely stabile and easily mounted on any of a variety of building structures.

SUMMARY OF THE INVENTION

The invention is a climbing device comprising a ladder with a pair of spaced apart upright members for leaning against a structure and a plurality of spaced apart rungs each extending between and supported by the upright members, a stabile support member having a base portion for securement to the structure and a retainer portion engaged with one of the rungs and selectively disengageable therefrom, and fastening means for fixing the base portion to the structure. The securely fastened stabile support prevents slippage of the ladder and together therewith provides a safe apparatus for climbing structures.

According to specific features, the invention comprises a pair of the support members, each base portion has a plate portion defining a plurality of openings, the fastening means comprises a plurality of fasteners received by the openings and adapted to penetrate the structure, and each retainer portion comprises a hook portion receiving the one rung of the ladder and engaging a different upright member thereof. This arrangement provides the desired safe climbing device with an efficient and easily used pair of support members.

According to another feature of the invention, the support member comprises a coupling connecting the base portion to the retainer portion and allowing relative movement therebetween in a sense orthogonal to the surface of the structure engaging the base portions. The coupling significantly enhances the utility of the device by permitting positional adjustment between the support members and the ladder.

According to yet another feature of the invention, the coupling comprises an adjustment mechanism for adjustably fixing the spacing between the base portions and the retainer portions. The adjustment mechanism further enhances the positional adjustment capability of the support members.

According to one embodiment of the invention, the retainer portion comprises a cross member separated from the base portion and extending transverse to the direction of separation between the base portion and the retainer portion, and a pair of hook portions each connected to a opposite end of the cross member. In this embodiment, a single support member having a pair of hook portions provides the desired ladder stability.

According to features of the aforementioned embodiment, the retainer portion includes a selective mechanism for adjusting the spacing between the hook portions which are detachable from the cross member and disposed to accommodate engagement with a rung of the ladder. These features permit use of a single support member with ladders of different width.

According to other features of the aforementioned embodiment, the hook portions are detachable from the cross member and each is disposed to accommodate engagement with a different upright of the ladder. The functionability of the climbing device is improved by providing interchangeable hook portions that can accommodate either rungs or uprights of the ladder.

According to an important feature of the invention, each retainer portion comprises a hook portion with an opening for receiving a rung of the ladder and a closure for closing the opening after the hook portion receives the rung so as to prevent disengagement therebetween. The closure securely retains the rung within the hook portion to significantly enhance the stability of the climbing device.

According to yet another feature of the invention, the coupling is further adapted to accommodate additional pivotal movement of the retainer portion in a plane transverse to the orthogonal pivotal movement. This feature permits use of the climbing device on intricately shaped structures.

BRIEF DESCRIPTION OF THE DRAWINGS

These and other objects and features of the invention will become more apparent upon a perusal of the following description taken in conjunction with the accompanying drawings wherein.

DETAILED DESCRIPTION OF THE DRAWINGS

Figure 1:
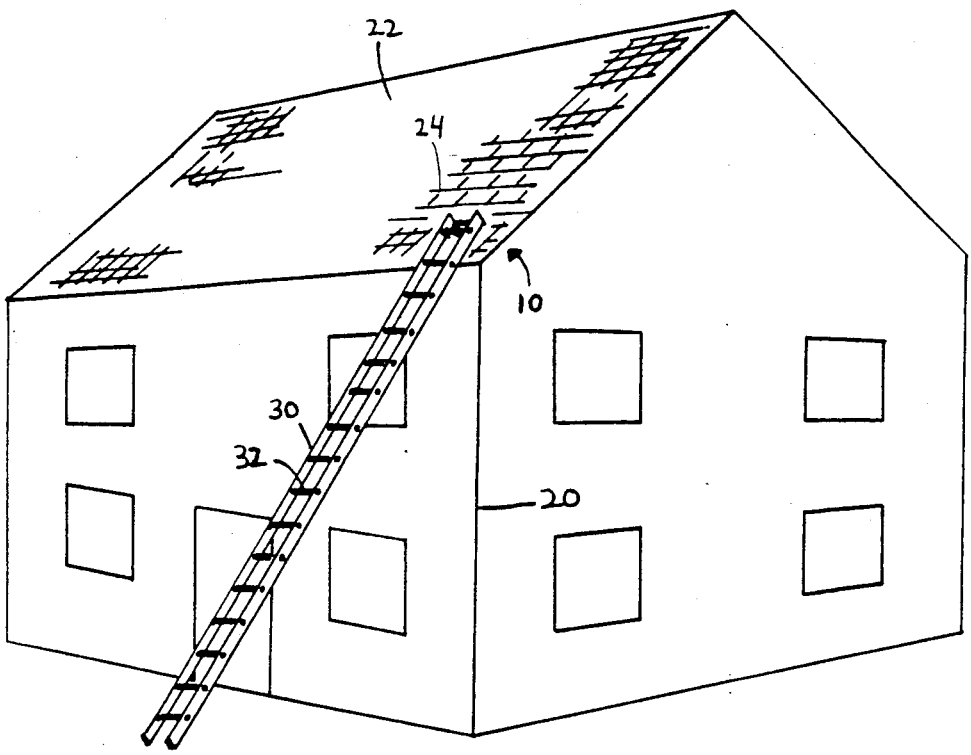
FIG. 1 is an illustrative side view of a ladder safey device positioned against a building.
Figure 2:
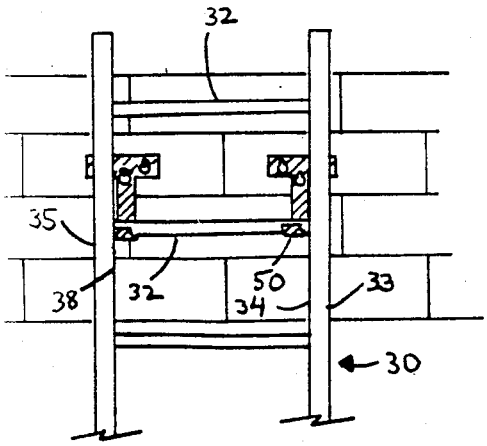
FIG. 2 is an isometric view of showing details of the device shown in FIG. 1.
Figure 3:
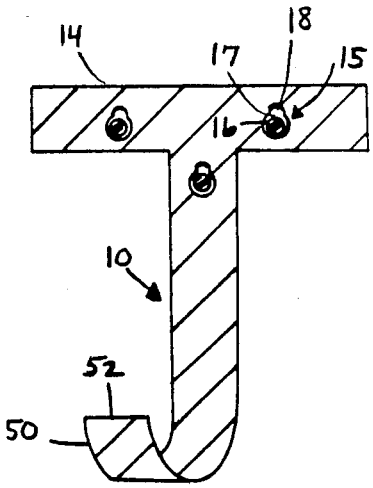
FIG. 3 is a perspective view showing a support portion of ladder safety device shown in FIGS. 1 and 2.

Referring now in particular to the accompanying drawings, my improved safety ladder device 10 is generally shown in FIGS. 1 and 2. Included in the device 10 is a stabile support 14 and a ladder 30 having rungs 32 extending between parallel, spaced apart upright members 34, 35 that rest against a house structure 20 with a roof 22 and shingles 24. As shown in FIG. 3, the support 14 has a base portion that defines a plurality of openings 15 each of which include a wide first hole 16 and a smaller hole 18 joined by a narrow channel 17 having tapered sides 19. Fastening nails are driven through the holes 16 into the roof 22 after which the support 14 is lowered to position the nails in the tighter holes 18. The base portion of the support 14 includes a transverse portion and a center portion that joins a curved retainer portion 50 that terminates in a hook portion 52. As shown in FIG. 2, a hook portion 52 of one support 14 retains one ladder rung 32 and engages an inner surface 34 of the upright member 33. The hook portion 52 of another support 14 similarly retains the same rung 32 and engages an inner surface 38 of the other upright 35.

During use, the supports 14 are easily carried up the ladder 30. The user then clamps the hook portions 52 of one of the supports 14 around the nearest available rung, pushes up the adjacent shingles, if desired, and positions the base portion against the roof 22. Three fastening nails then are driven into the roof 22 through the holes 16. Next the support 14 is adjusted downwardly to position the nails in the smaller holes 19 and the shingles 24 replaced. The same procedure is followed to mount another support 14. The ladder 30 is then safely retained in position.

Figure 4:
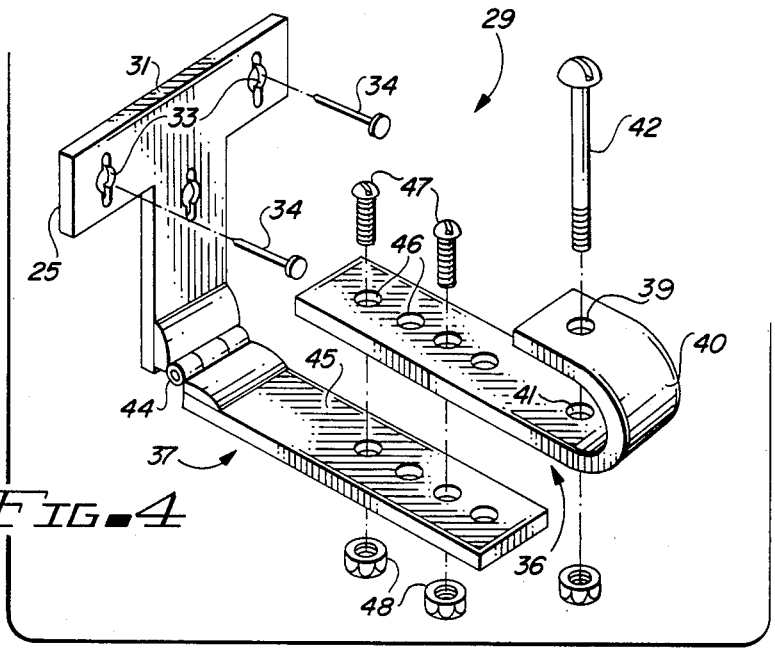
FIG. 4 is a schematic perspective view of another safety device support embodiment of the invention.

Referring now to FIG. 4 there is shown a modified safety support embodiment 29 of the invention. A T-shaped base plate 31 has openings 33 for receiving nail fasteners 34 and a rear contact surface 25 for engaging the support surface of a building structure. Connecting the base plate 31 to a retainer portion 36 is a coupling 37. The retainer portion 36 defines a hook portion 40 having aligned openings 39, 41 for receiving a closure pin 42. Included in the coupling 37 is a hinge assembly 44 that permits pivotal movement of the retainer portion 36 in a plane orthogonal to the contact surface 35. The coupling 37 also includes an adjustment plate 45 that supports the retainer portion 36. A plurality of rectilinearly aligned openings 46 extending through both the retainer portion 36 and the plate 45 can be selectively aligned to adjust the spacing between the base plate 31 and the retainer portion 36. Fixing of the selected separation is attained by a pair of bolts 47 that extend through aligned openings in the retainer portion 36 and the adjustment plate 45 and receive nuts 48.

Figure 5:
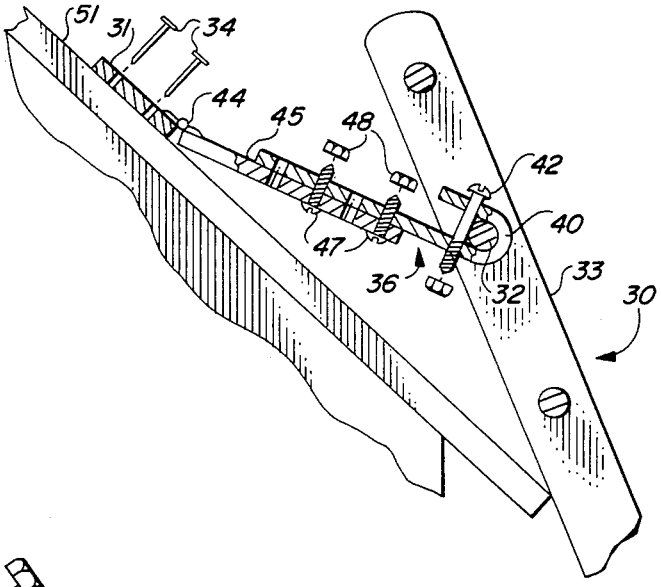
FIG. 5 is a schematic view showing the support embodiment of FIG. 4 secured to the roof of a house.

The support embodiment 29 is used similarly to the embodiment 10 shown in FIGS. 1–3. As shown in FIG. 5, the base plate 31 can be secured to a supporting roof surface 51 with the nails 34 that extend through the openings 33. The coupling 37 is then adjusted to position the hook portion 40 of the retainer portion 36 around the rung 32 of the ladder 30. Retention of the rung 32 within the hook portion 40 is insured by insertion of the pin 42 through the aligned openings 39, 41. Desired alignment of the retainer portion 36 with the rung 32 is provided by the hinge assembly 44 and selective adjustment of the retainer portion on the adjustment plate 45. Although a single support member 29 can be used to retain the ladder 30, the use of a pair of spaced apart support members 29 each engaging a different upright of the ladder 30 as shown in FIG. 3 is preferred.

Figure 6:
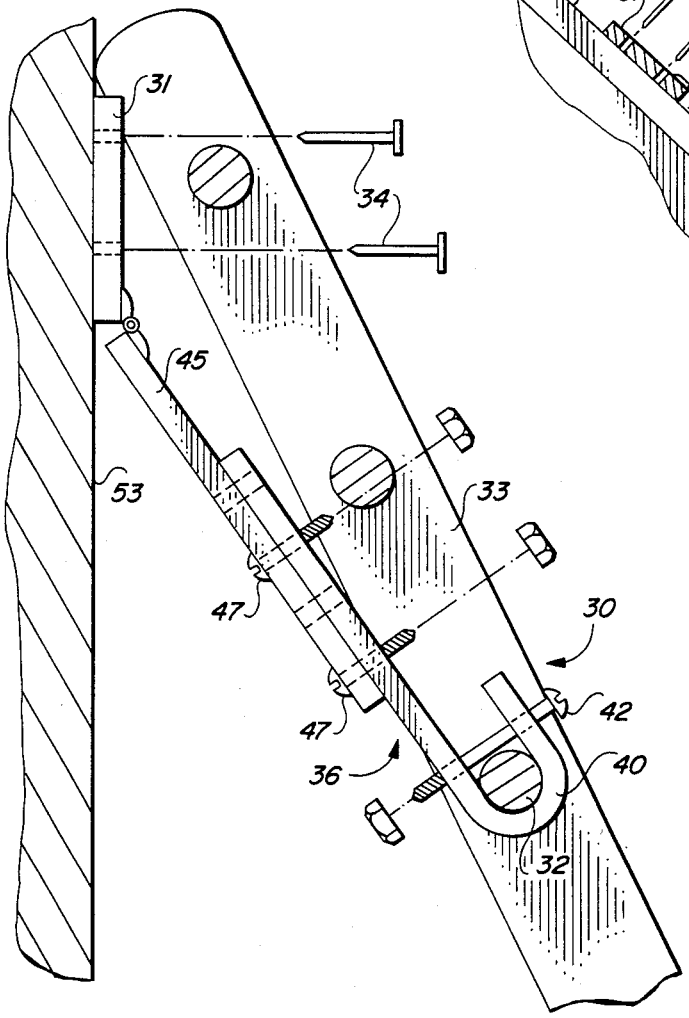
FIG. 6 is a schematic view showing the support embodiment of FIG. 4 secured to a side wall of a house.

FIG. 6 illustrates another use of the support member 29. In this case, the base plate 31 is secured to a vertical side wall support surface 53 of a building structure with the nails 34. After suitably positioning the ladder 30 with opposite ends of the uprights 33 engaging, respectively, the support surface 53 and the ground (not shown), the coupling 37 is employed to position the hook portion 40 around the rung 32. Insertion of the pin 42 then securely retains the rung 32 within the hook portion 40. Again, a pair of the support members 29, each engaging one of the ladder uprights, preferably is employed.

Figure 7:
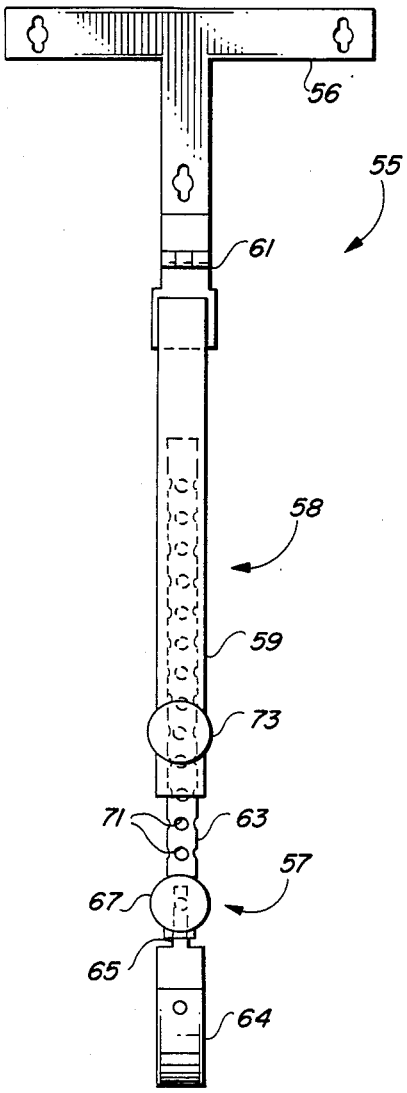
FIG. 7 is a schematic top view of another support embodiment of the invention.
Figure 8:
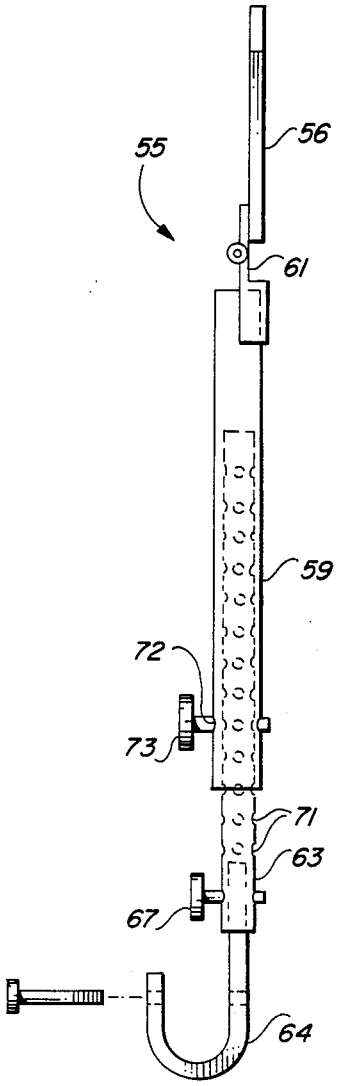
FIG. 8 is a schematic side view of the support embodiment shown in FIG. 7.

FIGS. 7 and 8 illustrate another safety support member embodiment 55 of the invention. A T-shaped base plate 56 is connected to a retainer portion 57 by a coupling 58. Included in the coupling 58 is a hollow tube 59 that is joined to the base plate 56 by a hinge assembly 61. The retainer portion 57 includes a retainer tube 63 and a hook portion 64 with an end 65 inserted thereinto. Retaining the hook portion 64 is a pin 67 received by aligned openings in the retainer tube 63 and the hook end 65. A plurality of longitudinally and circumferentially spaced apart holes 71 are formed in the retainer tube 63 which is received by the tubular member 59 and which has a hole 72 for receiving a pin 73. The retainer tube 63 can be longitudinally moved within the tube 59 to align the hole 72 with one of the holes 71 so as to provide a desired spacing between the hook portion and 64 and the base plate 56. In addition, the retainer tube 63 can be rotated within the tube 59 to align the opening 72 with a circumferentially positioned hole 71 that provides a desired angular orientation of the hook portion 64 in a plane transverse to the pivotal movement provided by the hinge assembly 61. The support embodiment 55 is used in the same manner as that described for the support embodiment 31. However, the coupling 58 enhances the operational flexibility of the device. Because the rotational position of the retainer tube 63 within the tube 59 can be adjusted, the angular orientation of the hook portion 64 can be selectively determined. This feature can be useful, for example, when a ladder is being employed on angularly intersecting roof surfaces.

Figure 9:
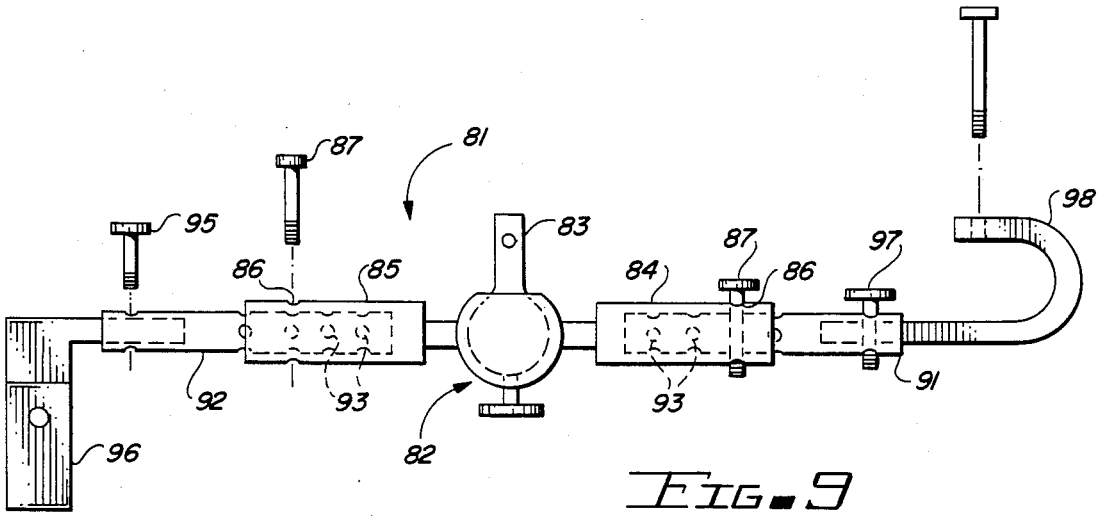
FIG. 9 is a schematic view of a modified retainer portion for use with the support embodiment shown in FIGS. 7 and 8.

FIG. 9 illustrates another safety support embodiment 81 of the invention. A locking ball and socket assembly 82 has a projecting stem 83 that can replace the hook portion 64 in the embodiment 55 of FIGS. 7 and 8. Extending in opposite directions from the ball assembly 82 are arms 84 and 85 that form a cross member. Each of the arms 84, 85 includes an opening 86 for receiving a pin 87. Received by the tubular arms 84, 85, respectively, are coupling tubes 91, 92 each having a plurality of longitudinally and circumferentially spaced apart holes 93. The coupling tubes 91, 92 can be longitudinally and rotationally positioned within the arms 84, 85 to align selected holes 93 with the holes 86. After establishment, a selected position is fixed by insertion of the pins 87. Received by the tubular coupling 92 and retained by a pin 95 is a right angle hook portion 96 that extends transversely to the cross member formed by the arms 84, 85. Received by the tubular coupling 91 and retained by a pin 97 is a hook portion 98 that is aligned with the cross member formed by the arms 84, 85.

During use of the support embodiment 81, the coupling 58 of FIGS. 7 and 8 is adjusted to suitably position the ball assembly 82. The tubular couplings 91, 92 are then adjusted to provide a desired spacing between the hook portions 96 and 98. Selective pivotal movement of the cross member formed by the arms 84, 85 in a plane transverse to the coupling 58 is provided by the ball assembly 82. The hook portion 96 can be positioned to engage a selected rung of a ladder while the hook portion 98 can be positioned to receive an upright thereof. It will be obvious that the hook portions 96 and 98 can be selected and exchanged according to the objects desired For example, a pair of hook portions 96 can be used to receive a single rung of a ladder or a pair of the hook portions 98 can be used to receive both uprights thereof.

Obviously, many modifications and variations of the present invention are possible in light of the above teachings. It is to be understood, therefore, that the invention can be practiced otherwise than as specifically described.

What is claimed:

1. A safety apparatus for securing a ladder to a structure and comprising:

base means for securement to the structure;

retainer means for engaging a ladder leaning against the structure; and coupling means connecting said base means to said retainer means and allowing relative movement therebetween, and said coupling means comprising adjustment means for adjustably fixing the spacing between said base means and said retainer means.

2. An apparatus according to claim 1 wherein said base means comprises a contact surface for contacting a support surface of the structure, and said coupling means accommodates pivotal movement of said retainer means in a plane orthogonal to the support surface.

3. An apparatus according to claim 1 wherein said base means comprises a contact surface for contacting a support surface of the structure, and said coupling means accommodates pivotal movement of said retainer means in a plane orthogonal to the support surface, and said adjustment means adjustably fixes the spacing between said base means and said retainer means in the plane of said contact surface.

4. An apparatus according to claim 1 wherein said coupling means accommodates relative movement of three senses between said base means and said retainer means.

5. An apparatus according to claim 4 wherein said base means comprises a contact surface for contacting a support surface of the structure, and said three senses of relative movement include pivotal movement of said retainer means in a plane orthogonal to the support surface.

6. An apparatus according to claim 4 wherein said base means comprises a contact surface for contacting a support surface of the structure, said three senses of relative movement include pivotal movement of said retainer means in a plane orthogonal to the support surface, and said adjustment means adjustably fixes the spacing between said base means and said retainer means in the plane of said contact surface.

7. An apparatus according to claim 6 wherein said retainer means comprises a cross member separated from said base means and extending transverse to the direction of separation between said base means and said retainer means and a pair of hook portions each connected to an opposite end of said cross member.

8. An apparatus according to claim 7 including selective means for adjusting the spacing between said hook portions.

9. An apparatus according to claim 8 wherein said hook portions are detachable from said cross member and disposed to accommodate engagement with a rung of the ladder.

10. An apparatus according to claim 8 wherein said hook portions are detachable from said cross member and each is disposed to accommodate engagement with a different upright of the ladder.

11. An apparatus according to claim 1 wherein said retainer means comprises a hook portion with an opening for receiving a rung of the ladder, and including closure means for closing said opening after said hook portion receives the rung so as to prevent disengagement therebetween.

12. An apparatus according to claim 11 wherein said base means comprises a contact surface for contacting a support surface of the structure, and said coupling means accommodates pivotal movement of said retainer means in a plane orthogonal to the support surface.

13. An apparatus according to claim 11 wherein said base means comprises a contact surface for contacting a support surface of the structure, and said coupling means accommodates pivotal movement of said retainer means in a sense orthogonal to the support surface, and said adjustment means adjustably fixes the spacing between said base means and said retainer means in the plane of said contact surface.

14. An apparatus according to claim 2 wherein said coupling means is further adapted to accommodate additional pivotal movement of said retainer means in a plane transverse to said pivotal movement.

15. An apparatus according to claim 1 including locking means actuatable to prevent certain senses of relative movement between said base means and said retainer means.

* * * * *